US005551721A

United States Patent [19]

Renaud-Goud et al.

[11] Patent Number: 5,551,721

[45] Date of Patent: Sep. 3, 1996

[54] SKI BRAKE

[75] Inventors: Gilles Renaud-Goud, Annecy; Pierre Szafranski, Pringy; Jean-Francois Merino, Annecy le Vieux, all of France

[73] Assignee: Salomon S.A., Chavanod, France

[21] Appl. No.: 276,851

[22] Filed: Jul. 18, 1994

[30] Foreign Application Priority Data

Jul. 16, 1993 [FR] France ..... 93 08914

[51] Int. Cl.[6] ..... A63C 7/10

[52] U.S. Cl. ..... 280/605

[58] Field of Search ..... 280/604, 605; 188/5

[56] References Cited

U.S. PATENT DOCUMENTS

| | | | |
|---|---|---|---|
| 4,268,060 | 5/1981 | Svoboda | 280/605 |
| 4,294,459 | 10/1981 | Svoboda et al. | 280/605 |
| 4,708,360 | 11/1987 | Peyre | 280/605 |
| 4,878,687 | 11/1989 | Stritzl et al. | 280/605 |
| 4,973,072 | 11/1990 | Stritzl et al. | 280/605 |

FOREIGN PATENT DOCUMENTS

| | | | |
|---|---|---|---|
| 264664 | 4/1988 | European Pat. Off. . | |
| 2508325 | 12/1982 | France | 280/605 |
| 229624 | 2/1944 | Switzerland | 280/605 |

OTHER PUBLICATIONS

Search Report FR 93 08914, Mar. 30, 1994.

*Primary Examiner*—Karin L. Tyson

*Attorney, Agent, or Firm*—Pollock, Vande Sande & Priddy

[57] ABSTRACT

A ski brake designed to slow the travel of a ski. The brake comprises two brake arms (2, 3) incorporating two functional braking segments (4, 5) movable in rotation between a functional braking position and a non-functional resting position around a substantially transverse pin (10, 11) borne by a base (20), two actuators (12, 13) of the brake arms which extend beyond the transverse hinge pin, and a return spring (35). The brake arms (2, 3) are independent, the return spring (35) is independent of the brake arms, and this spring incorporates laterally two devices (36, 37) for connection to the actuators (12, 13) belonging to the brake arms, and, in its central area, a loop (40) extending downward toward the support and whose lower base (41) rests against the upper surface of this support.

9 Claims, 6 Drawing Sheets

SKI BRAKE

FIELD OF THE INVENTION

The invention relates to a ski brake. Brakes of this kind are widely used to slow the travel of a ski in motion when the boot has been released by he bindings which hold it in place.

BACKGROUND OF THE INVENTION

In conventional fashion, a ski brake comprises one, and preferably two, brake arm, which move between an operative braking position, in which they project outward beneath the lower ski surface, and a non-operative resting position, in which they are folded back above the upper ski surface. In the non-operative position, the brake arms are, moreover, advantageously drawn back toward the longitudinal is of the ski, in order to avoid the risk of catching in the snow or with the other ski during skiing.

Moreover, an elastic return means draws the brake arms back into their operative braking position, in particular in order to bring the arms back into the operative position as soon as the boot has been released.

In general, the brake arms are jointed around a transverse pin borne by a base attached to the ski or to the binding base plate. The arms are, furthermore, extended beyond the base, and a device such as a pedal or roller is connected to the extensions of these arms. This device acts on the extensions and on the brake arms, which they cause to be raised then the boot is engaged in the position-retention elements.

In some brakes, the spring is formed by a loop of metal wire possessing a high degree of elasticity and on which stress is generated to deform it, mainly by twisting it. This brake is, for example, described in the DE-DOS number 24 12 623.

This brake gives good results, but proves disadvantageous because its construction is not very economical. In fact, it incorporates a large number of components, since the spring is separate, and, moreover, at a distance, from the brake arms.

In other brakes, the return spring is made of a loop of the same wire as that employed for the arms. That is, the brake arms and the spring form a single component. This brake is described, for example, in DE-OS 25 54 110 with reference to the embodiment illustrated in FIGS. 1, 2 and 5. This brake has a metal wire folded so as to form an "M" shape. The legs of this "M" constitute the brake arms and are mounted so as to pivot around a transverse pin. In side view, the central portion of the "M" forms an angle with the plane of the brake arms, and its lower portion is supported on the base or on a block fastened to the latter. When the brake arms are placed in the non-operative position, the central portion of the "M" is forced to re-enter the plane of the brake arms, thereby giving rise to a return force caused by the deformation of the wire.

The brake has the advantage of a very simple, reliable structure. However, its disadvantage results from the fact that the stiffness of the return spring is dictated by the wire used for the brake arms, or vice-versa.

In other words, the brake arms advantageously possess a slight deformation capability, so as to damp the jolts produced in the active braking phase.

From another perspective, the return spring elastically opposes the rising motions of the brake arms, and then, if required, the return movements of the brake arms toward the longitudinal axis of the ski.

In the case of a brake like that described in DE-OS 25 54 110, it is not possible to control individually the inherent elasticity of the brake arms on one side, and the stiffness of the return spring and of the return movement of the spades on the other side. In fact, this is the same wire which forms the three brake components.

Another disadvantage lies in the design of the base and in the assembly of the "M"-shaped wire to the base. In fact, the base is subjected to pronounced stresses because the spring is made using the same wire as that employed for the brake arms, and that, accordingly, relative stiff. Furthermore, the base must make possible the assembly of the "M"-shaped loop in its entirety.

SUMMARY OF THE INVENTION

One of the objects of the invention is to solve these problems by proposing a brake of this type incorporating simple construction, and in which the stiffness of the rising motion of the brake arms and the stiffness of the return motion of the brake arms are independent of the elasticity of the brake arms.

Another object of the invention is to propose a brake in which the base is subjected to relatively low levels of stress.

The invention is further intended to propose a brake whose assembly does not impose special design constraints.

Other objects and advantages of the invention will emerge from the following description of.

The brake according to the invention comprises two brake arms incorporating two active braking segments which can rotate between an operative braking position and a non-operative rest position around a substantially transverse pin carried by a base, two devices actuating the functional segments of the brake arms and extending beyond the transverse hinge pin, and a return spring which acts on the extensions of the brake arms in order to bring the brake arms elastically back into the operative braking position.

The brake according to the invention is characterized by the fact that the return spring is independent of the brake arm and that the brake comprises laterally two means for connection onto the extensions of the brake arms and, in its central area, a loop descending toward the base and angularly offset in relation to the plane formed by the extensions of the brake arms, of which the lower portion is supported against the upper surface of the base.

BRIEF DESCRIPTION OF THE DRAWINGS

The invention will be better understood by referring to the description below and to the drawings forming an integral part thereof.

DESCRIPTION OF THE PREFERRED EMBODIMENT

Figure 1:
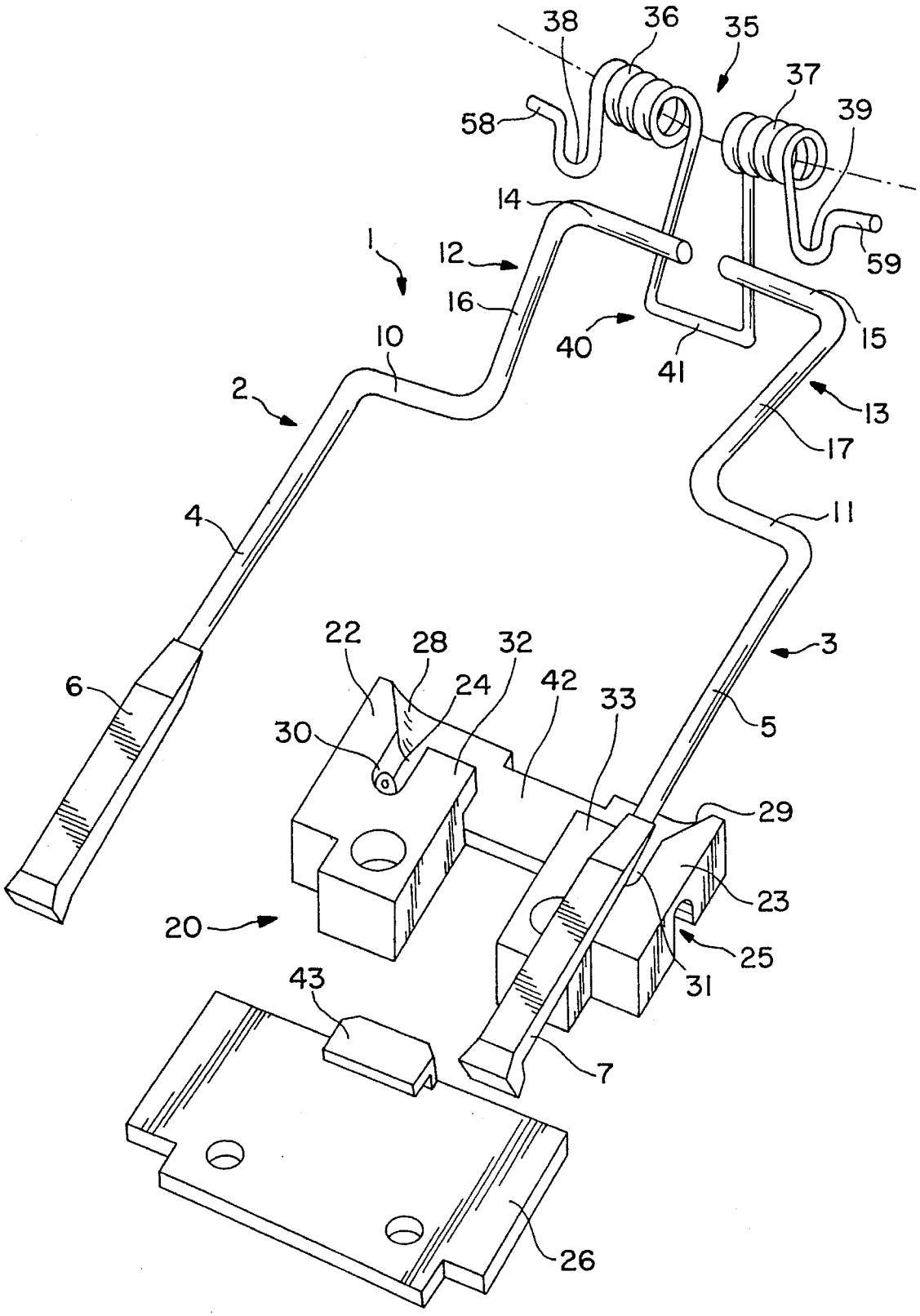
FIG. 1 is an exploded perspective view of a brake according to a first embodiment of the invention.

FIG. 1 shows that the brake comprises two brake arms 2 and 3. The arms are made of any suitable material, advantageously steel wire having a diameter of approximately 5 mm.

Each brake arm incorporates a operative braking segment 4, 5, whose lower end ends in duplicate-molded part 6, 7.

In the operative braking position, the arms are normally inclined downwardly and forwardly in relation to the ski.

In their central portion, the brake arms are folded inward so as to form a rotational segment 10, 11 extending transversely and horizontally.

Beyond the rotational segments, the arms incorporate in a continuous configuration actuators 12, 13. The actuators control the various movements of the brake arms, i.e., the movement of rotation around the rotational segments and the return movement of the brake arms toward the longitudinal axis of the ski.

The actuators consist of two portions, a connection segment 14, 15 and an intermediate segment 16, 17. The intermediary segments 16, 17 diverge beginning at the inner end of the rotational segments and toward the outside of the ski, and the connection segments 14, 15 are in approximate alignment with each other.

In the example shown, the operative segments and the actuators fall within the same plane. This configuration is not restrictive, and the actuators could be raised in relation to the operative segments.

The brake arms 2 and 3 are supported by a base 20, which comprises mainly, on each lateral edge, a part 22, 23 having a transverse opening 24, 25 and forming a bearing for each rotational segment 10, 11 belonging to the brake arms.

In the embodiment shown, the transverse openings 24, 25 are delimited on the lower surface of the base 20 by the upper surface of a backplate 26, which is set on the lower surface of the base. This method of construction is not, however, restrictive for the invention.

In cross-section, the bearings have dimensions greater than those of the rotational segments, so as to leave relatively significant functional operative play. Moreover, the width of the bearings 22, 23 is smaller than the length of the rotational segments 10, 11, an arrangement linked to the return movement of the brake arms. When the brake arms are raised to the horizontal, they can move transversely in the bearings so as to draw the functional operative segments back above the ski. This arrangement will be described below in greater detail.

To the front of the openings 24, 25, the portions 22 and 23 forming bearings incorporate two inclined surfaces 28, 29 set opposite each other and which extend downward and inward. These inclined surfaces cooperate with the intermediate segments 16, 17. At the end of the rising movement of the operative segments, the intermediate segments 16 and 7 come to be supported on these inclined surfaces 28, 29, thereby returning these segments and the operative segments toward the longitudinal median axis of the ski.

According to a preferred embodiment, the intermediate segments are positioned on the inclined surfaces 28, 29 when the ends of the duplicate-molded pieces 6 and 7 reach the height of the sole of the ski. Accordingly, the return motion of the brake arms occurs at the time of the last phase of the rising motion of the arms.

Preferably, the bearings are bordered inwardly by notches 30, 31 delimited to the inside by a horizontal tongue 32, 33 extending forward. The notches are slightly wider than the diameter of the wire composing the arms 2 and 3, and they are slightly flared as they extend forward. The bases of the intermediate segments come to be housed in the notches when the operative segments are positioned below the ski sole, i.e., when the intermediate segments are not in contact with the inclined surfaces 28, 29. These notches impede the movement drawing the brake arms closer together for as long as the actuators are engaged therein, i.e., for as long as the operative segments are not raised above the sole of the ski. They also facilitate the positioning of the brake arms at the moment when the brake opens toward its operative position.

The brake illustrated in FIG. 1 further comprises a device for elastic return to the operative braking position. This mechanism is formed by a spring 35 made of steel spring wire having a diameter smaller than the wire used to make the brake arms 2 and 3. Furthermore, its mechanical flection properties are independent of those of the arms 2 and 3.

The spring 35 has, on each side, means for connection onto the brake arms 2 and 3. These means are formed by two windings 36, 37, with stubs 58,59 which fit into the connection segments 14, 15. The inner dimensions of the windings 36, 37 are slightly larger in cross-section than the outer dimensions of the connection segments 14 and 15. The windings 36 and 37 are symmetrical.

Toward the outside, the windings 36, 37 have hook-shaped ends 38, 39 which hook onto the upper part of the intermediate segments 16, 17.

In the center, the spring incorporates a loop 40 extending toward the base 20. This loop has a rectilinear lower base 41 which rests on the upper surface 42 of the base 20 in front of the openings 25 and 26 of the bearings. To the front, the motion of the base 41 is limited by a hook 43 which opens toward the rear. In the embodiment shown, the hook is formed by the part of the backplate 26 extending above the front portion of the base 20.

Seen from the side, the loop 41 is so positioned in relation to the hooks 38,39 that, after the spring is fitted onto the segments 36, 37 and the hooks 38, 39 are put in place on the segments 16, 17, the loop 41 is directed forward in relation to the intermediate segments. In other words, seen from the side, the loop has, in relation to the horizontal, an inclination more pronounced than that of the intermediate segments. The inclination of the loop does not, however, exceed the vertical and is sufficiently distant from the vertical so that a vertical pressure exerted on the connection segments 14 and 15 causes the base 41 of the loop to slide rearward. The hook may have a small inclined surface which facilitates the incipient sliding motion of the base 41.

Preferably, the base 41 when at rest tends to be positioned in front of the hook 43, so that the positioning of the base in the hook prestresses the spring. The windings 36 and 37 tend to become tightened on the segments 14 and 15 when the loop 41 moves toward the plane of the segments 16 and 17.

Figure 2:
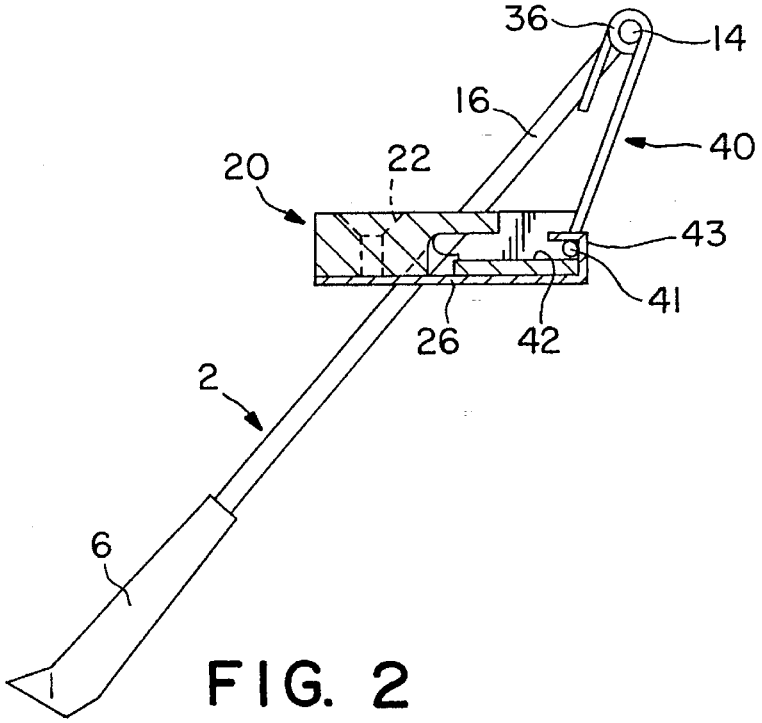
FIG. 2 is a side view of the brake in FIG. 1, shown in the operative braking position.
Figure 3:
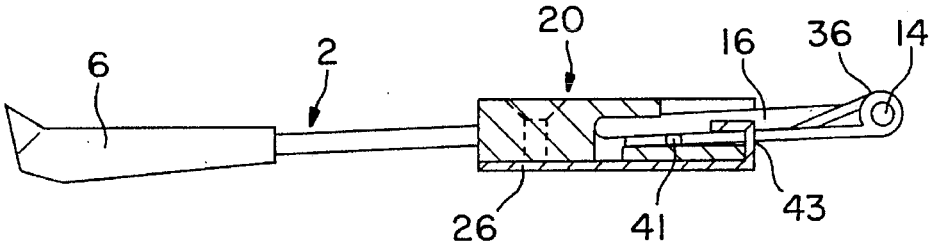
FIG. 3 is a side view of the brake in FIG. 1, in the non-operative position.

As illustrated in FIGS. 2 and 3, the movement of the brake arms 2 and 3 from their operative braking position (FIG. 2)

to their non-operative position (FIG. 3 ) forces the loop to become aligned with the intermediate segments 16 and 17. By virtue of this movement, the base 41 of the loop slides on the base and moves away from the hook toward the rotational segments 10 and 11. The tightening of the turns of the windings 36 and 37 and the resulting flection of the loop 40 generate a return force of the spring toward the active braking position of the arms 2 and 3. This return force is added to the initial pretensioning of the spring 35.

Preferably, the spring 35 also exerts on the brake arms a pretensioning force extending within the plane of the brake arms, which tends to move the operative segments 4 and 4 away from each other.

In FIG. 1, the windings 36 and 37 are, in their initial state, offset in relation to each other. The axes of the windings form an obtuse angle extending opposite to the loop 41. The engagement of windings on the brake arms brings the windings back approximately into axial alignment, thereby forcing the loop 41 to open and causing a pretensioning which tends to draw the operative segments 4, 5 away from each other.

Figure 4:
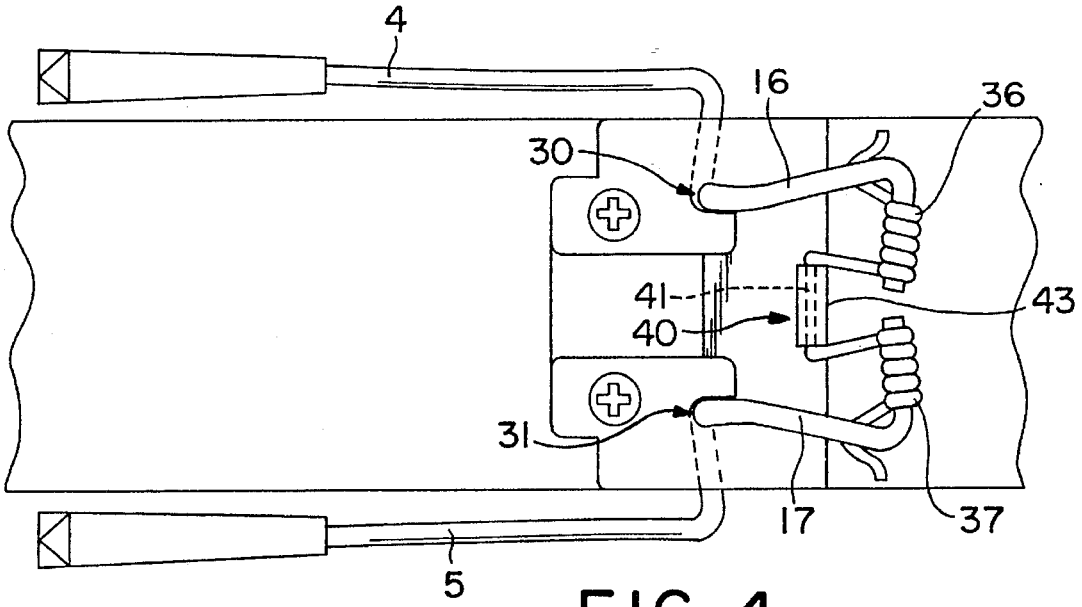
FIG. 4 is a top penn view of the brake in FIG. 1, in the operative braking position.

FIG. 4 is a top plan view of the brake in FIG. 1 in the operative braking position. This figure shows that the intermediate segments 16, 17 are engaged in the notches 30, 31, thereby keeping the operational segments 4, 5 spaced apart.

Figure 5:
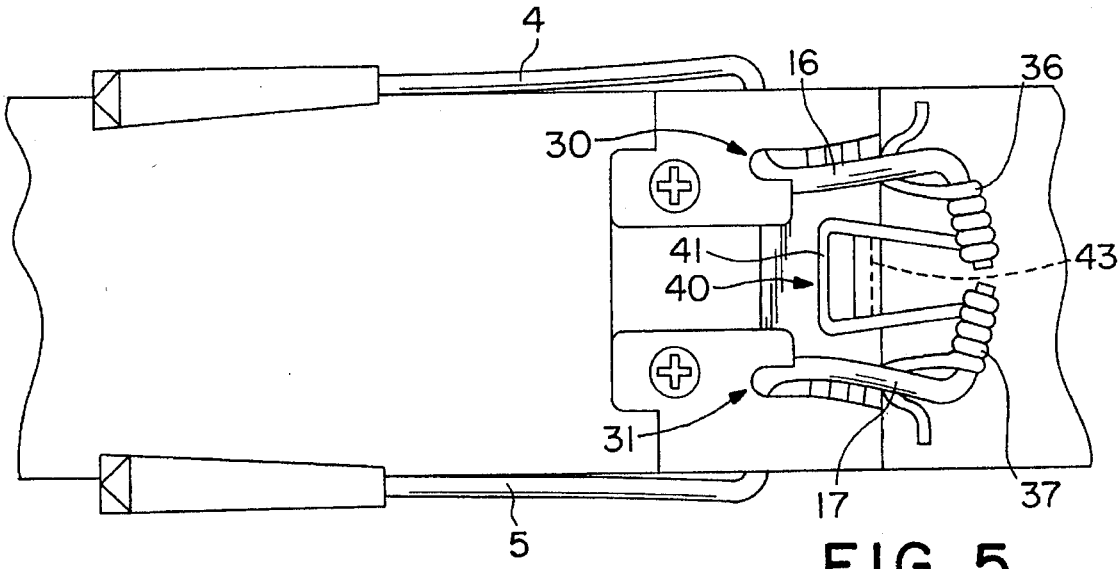
FIG. 5 is a top penn view of the brake in FIG. 1, in the non-operative position.

FIG. 5 illustrates the same brake in the non-operative position, in which the base 41 of the loop 40 has slid backward. The intermediate segments 16, 17 have come out of the notches 30, 31, and cooperation with the inclined surfaces 28, 29 has brought the operational segments 4, 5 closer together at the end of travel. During this return movement, the rotational segments slide in the bearings 24, 25 in an approximately circular motion occurring totally in a transverse direction.

Furthermore, this return motion of the operational segments increases the opening of the loop 40, thereby generating a return force added to that originating in the initial offset configuration of the windings 36 and 37. This return force causes the brake arms 2 and 3 to move apart as soon as they return to the operational position.

At the time of this return movement, the base 41 of the loop 40 is once again positioned in the hook 43, which forms a stop for the brake when the operational segments are stressed in a reverse direction, i.e., from left to right in FIG. 2. Moreover, it maintains the pretensioning of the spring 35.

The brake assembly in FIG. 1 can be produced in different ways. For example, if the base is made in two parts, the spring fire onto the brake arm, then this assembly is put in place in the bearings in the base, and finally, the base is assembled. According to another method, the base is assembled, then each brake arm is engaged in its respective bearing, and finally, the spring is fitted onto the arms. The base may be assembled to the ski or to the base plate of a front or rear binding using any suitable conventional means.

The brake just described can be linked to any suitable actuating means sensitive to the presence of the boot on the ski.

Figure 6:
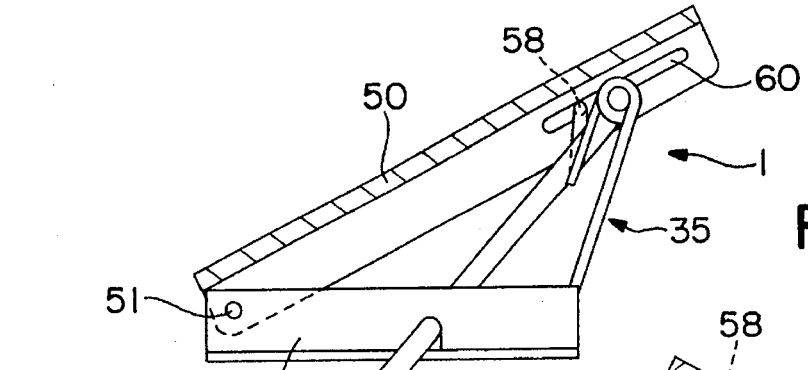
FIGS. 6, 7, 8, and 9 illustrate are side views, partly cross-section, of the brake in FIG. 1, equipped with a pedal for engagement of the boot.

For example, FIG. 6 shows the brake 1 linked to a pedal 50 jointed to the base 52 around a pivot pin 51 located to the rear of the bearings 24, 25.

Figure 7:
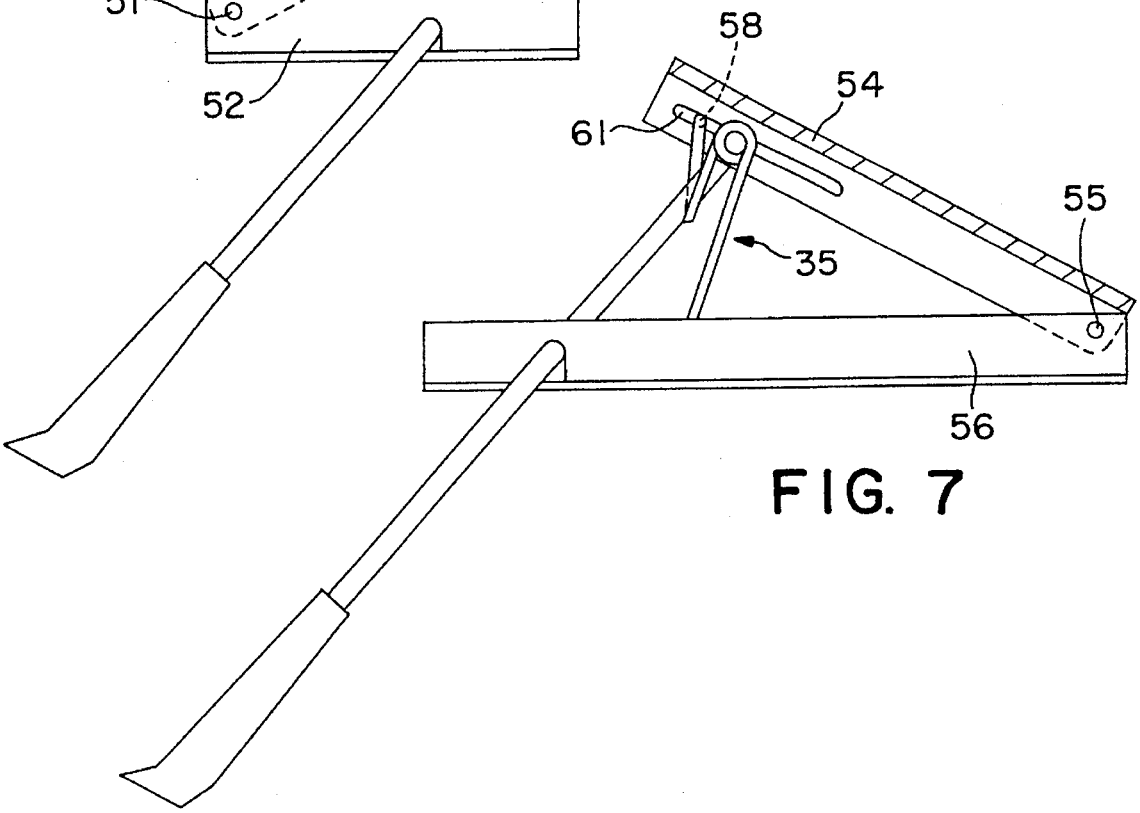

FIG. 7 illustrates a pedal 54 jointed to the base 56 around a pivot pin 55 positioned toward the front of the bearings 24, 25.

In both cases, the pedal 50 or 54 rests in the windings 36 and 37 of the spring 35.

The spring may potentially incorporate, beyond the hooks 38 and 39, a stub 58, 59 which is housed and slides in a lateral groove in the pedal, as shown schematically at 60 for the pedal 50 and at 61 for the pedal 54.

Figure 8:
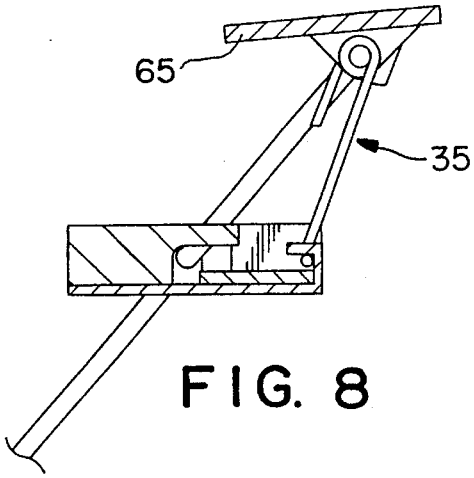

FIG. 8 illustrates another variant, according to which the central portion of the pedal 65 is directly jointed to the windings 36, 37 of the spring or to the connection segments 14, 15.

Figure 9:
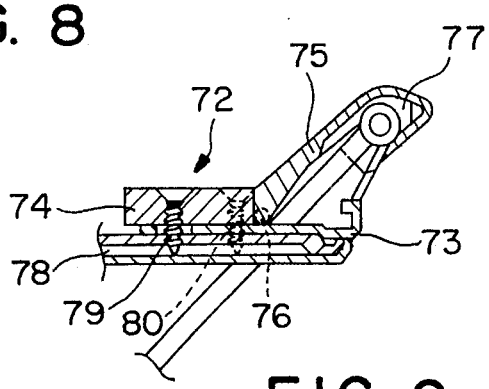

FIG. 9 shows a variant, in which the base 72 comprises a lower backplate 73 and an upper base 74. The lower backplate has, on its front portion, the hook which holds the loop of the spring in place. A pedal 75 actuating the brake is jointed around a pivot pin 76 housed at the connection point of the backplate of the base. The pedal 75 has, in its upper part, a kind of gusset 77 in which the spring windings are housed. The windings move in the gusset 77 during brake operation.

According to this variant, the base 72 is attached by a central screw 79 to the front part of the slide-track shown schematically at 78 and belonging to the binding. This assembly has, moreover, at least one hole 80 for the screws used to assemble the binding to the ski, so that the screw head rests on the base of the brake.

Figure 10:
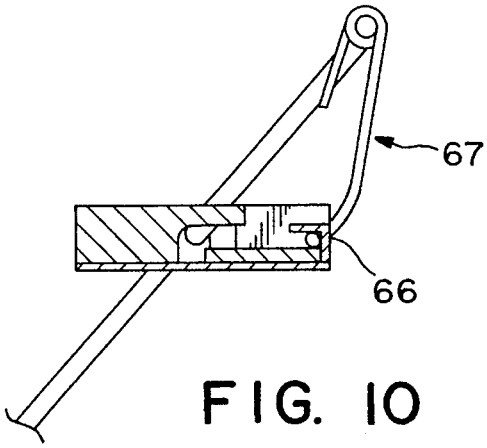
FIG. 10 is a side view in cross-section of a variant of the brake in FIG. 1.

FIG. 10 illustrates a variant of the spring, according to which the base 66 of the spring 67 is substantially bent in such a way that the sliding motion of this base on the support is accompanied by a rolling motion as the arms travel from the operative to the non-operative position. This makes it possible to reduce the lever arm by means of which the return moment of the spring is applied to the braking arms.

Figure 11:
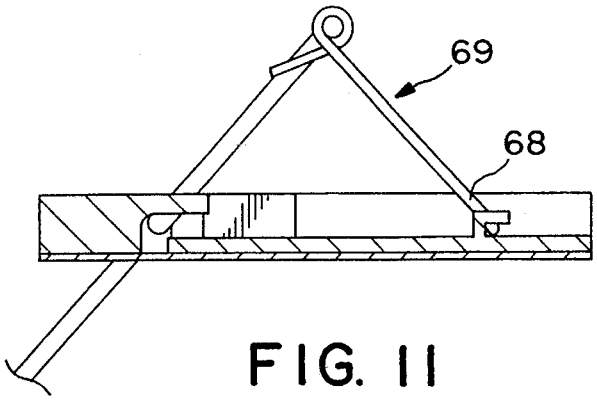
FIG. 11 illustrates another embodiment of the brake.

FIG. 11 illustrates a variant, in which the loop 68 of the spring 69 extends not rearward in the direction of the rotational segments, but forward. In this case, the movement of the brake into its non-operative position moves the base of the loop even further away from the rotational segments. The direction in which the turns are wound is reversed for the two spring windings, in such a way that the windings tighten on the connection segments as the brake moves into the non-operative position.

Figure 12:
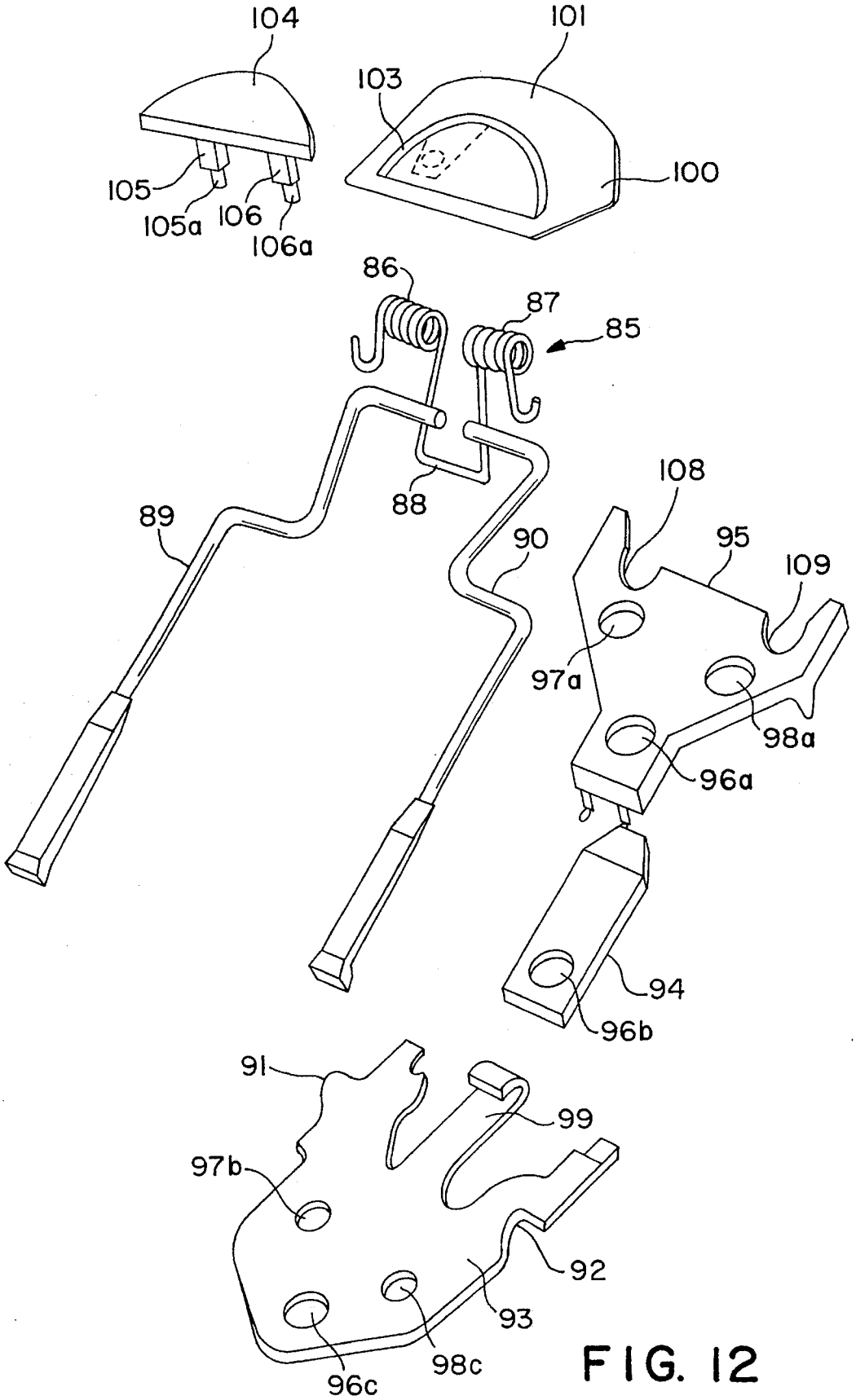
FIG. 12 is an exploded perspective view of another variant.
Figure 13:
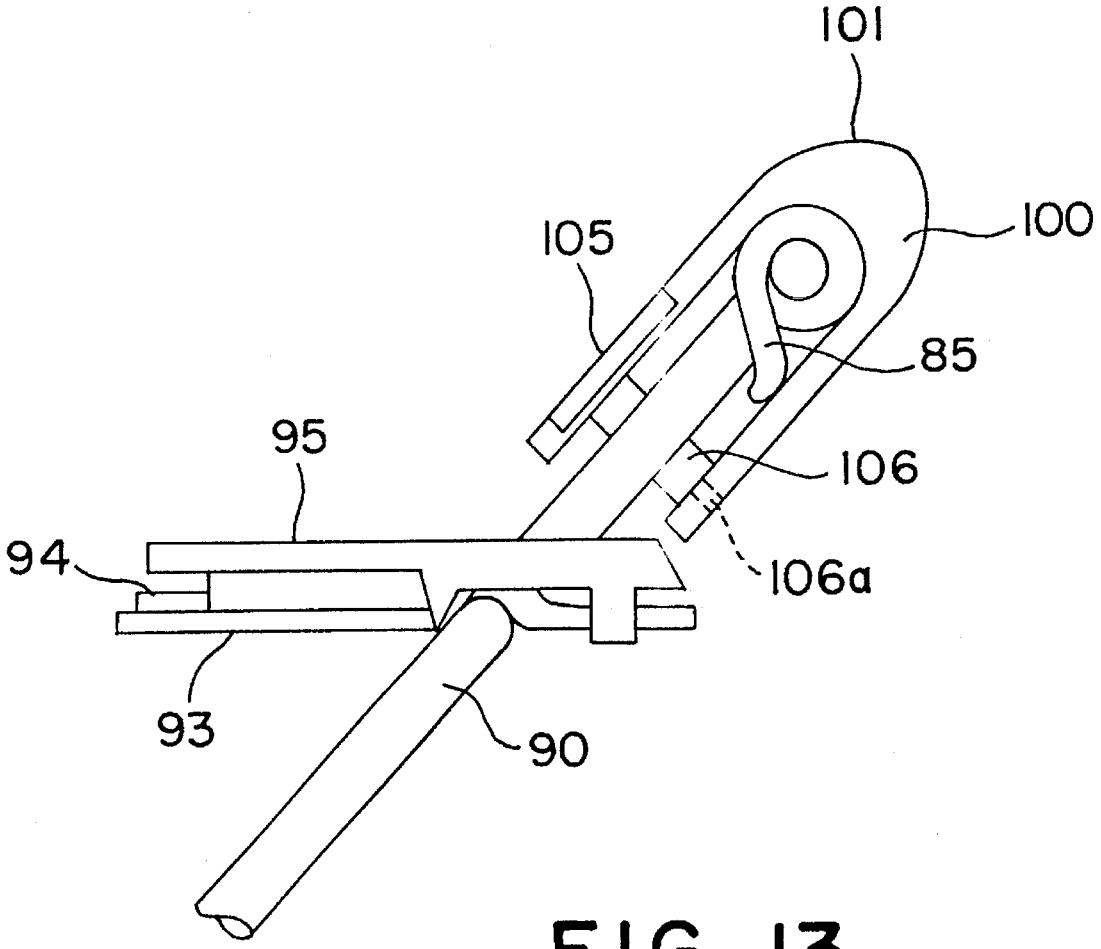
FIG. 13 is a side view partly in cross-section, of the brake in FIG. 12.

FIGS. 12 and 13 show another embodiment, in which the pedal is connected to the spring loops and to the intermediate segments of the brake arms.

This variant makes use of a spring 85 of the same type as the spring 35 previously described, and it comprises two windings 86, 87 nd a central loop 88. The stubs 58 and 59 are not useful here.

The brake also has brake arms 89 and 90 of the same type as the arms 2 and 3 previously described.

The arms are here mounted in rotation in recesses 91 and 92 in a backplate 93. Preferably, the backplate is made of metal and is surmounted by a small reinforcing plate 94 and a base 95 made, for example, of plastic.

Toward the front, the backplate has a tongue 99 whose end is folded back so as to receive the base of the loop 88 of the spring 85.

The assembly comprising the base, the small plate, and the backplate is configured to be assembled to an attachment slide-track using a screw housed in the rear orifices **96*a*, 96*b*, 96*c* and to the ski using two screws housed in the holes 97*a*, 97*b* and 98*a*, 98*b***, which, moreover, pass through the corresponding holes in the slide-track.

The small plate 94 is not indispensable, but it is preferred in order to reinforce the backplate 93. In the embodiment chosen, only the screws inserted in the holes **96*a*, 96*b* and 96*c*** extend through the plate.

Toward the front, the base 95 incorporates the notches 108, 109, which control the return motion of the brake arms along the body at the end of the rising movement of the brake arms.

In addition, the brake has a boot-engagement pedal 100, which is provided so as to fit onto the upper part of the brake arms 88 and 90 and on the windings 86 and 87 of the springs, when these components are assembled.

The pedal preferably has an upper rounded part 101 which facilitates the sliding and rolling motions of the pedal beneath the boot sole.

Furthermore, the pedal incorporates, on its top face, a wide recess 103 in the approximate shape of a quarter-moon. This recess serves to receive a small, similarly-shaped plate 104, and two pins 105 and 106 placed underneath form braces in conjunction with the underside of the pedal.

When the plate 104 is assembled to the pedal 100, the pins 105, 106 pass through the pedal between the brake arms 89 and 90, i.e., between their intermediate segments. The pins 105 and 106 are extended by stubs 105*a* and 106*a* which pass through the holes in the underside of the pedal 100, and which fused there, in order to weld together the entire assembly.

The pedal and its plate are assembled to the brake arms using this means. They also hold in place the connection of the windings 86 and 87 of the spring to the brake arms.

Preferably, the spring 85 is provided to move the brake arms 89 and 90 naturally closer together. The notches 108 and 109 are provided to prevent the brake arms from moving together as long as the brake arms have not been raised to a sufficient height above the ski.

What is claimed is:

1. A ski brake designed to slow travel of a ski in motion following release of a ski boot, said ski brake comprising:

(a) two separate brake arms, each brake arm incorporating a braking segment movable between an operative braking position and a non-operative rest position, a rotational segment extending transversely to the braking segment, and an actuator, the actuator including an intermediate segment and a transverse connection segment, said transverse connection segments of said brake arms being substantially aligned;

(b) a base, the base having a transverse opening forming a bearing for each rotational segment, said rotational segments being movably held within the transverse openings; and (c) a return spring made of a wire and separate from said brake arms acting on said actuators of said brake arms in order to bring said braking segments elastically back into operative braking position, said return spring having a central area comprising a loop extending toward said base, said loop having a lower base which rests against an upper surface of said base in front of said transverse openings, each side of said loop terminating in a winding made of the wire used to make said spring, said windings of said spring being fitted on said transverse connection segments of said brake arms, in order to connect said spring to said actuators, and incorporating, toward the outside, hook-shaped ends which grip said actuators of said brake arms.

2. The ski brake according to claim 1, wherein said loop (40) incorporates an inclination to the horizontal greater than that of the plane formed by said actuators (16, 17).

3. The ski brake according to claim 2, wherein the wire of said windings (36, 37) is wound on said actuators (38, 39) in a direction such as to tighten said windings on said actuators when said loop (40) is brought into the plane of said actuators (12, 13).

4. A ski brake according to claim 1, wherein said windings (36, 37) of said spring, in rest position, have axes which form an obtuse angle.

5. The ski brake according to claim 4, wherein said obtuse angle is formed opposite said loop, prior to assembly so that, after assembly, said loop (40) is prestressed in an open position.

6. The ski brake according to claim 1, wherein said support covers a backplate (26, 93) incorporating, in front of said transverse pin, a rearwardly opening hook (43) in which said base (41) of said loop (40) is engaged in the operative position of said brake arms.

7. The ski brake according to claim 6, wherein, in said operative braking position, said base (41) of said loop (40) is prestressed in said hook (43) which holds said hook in place.

8. A ski brake designed to slow travel of a ski in motion following release of a ski boot, said ski brake comprising:

(a) two separate brake arms, each brake arm incorporating a braking segment movable between an operative braking position and a non-operative rest position, a rotational segment extending transversely to the braking segment, and an actuator, the actuator including an intermediate segment and a transverse connection segment, said transverse connection segments of said brake arms being substantially aligned;

(b) a base, the base having a transverse opening forming a bearing for each rotational segment, said rotational segments being movably held within the transverse openings; and (c) a return spring made of a wire and separate from said brake arms acting on said actuators of said brake arms in order to bring said braking segments elastically back into operative braking position, said return spring having a central area comprising a loop extending toward said base, said loop having a lower base which rests against an upper surface of said base in front of said transverse opening, each side of said loop terminating in a winding made of the wire used to make said spring, said windings of said spring being fitted on said transverse connection segments of said brake arms, in order to connect said spring to said actuators, and incorporating, toward the outside, hook-shaped ends which grip said actuators of said brake arms;

(d) wherein said base covers a backplate which incorporates a rearwardly opening hook in which said lower base of said loop engages in the operative position of said brake arms.

9. A ski brake according to claim 8, wherein, in said operative braking position, said base of said loop is prestressed in said hook, which holds it in place.

* * * * *